US010277975B2

(12) United States Patent
Monaghan

(10) Patent No.: US 10,277,975 B2
(45) Date of Patent: Apr. 30, 2019

(54) HEADSET ACCESSORY

(71) Applicant: HEDSET, LLC, Lake Forest, CA (US)

(72) Inventor: Jeffrey Robert Monaghan, Lake Forest, CA (US)

(73) Assignee: HEDSET, LLC, Lake Forest, CA (US)

( * ) Notice: Subject to any disclaimer, the term of this patent is extended or adjusted under 35 U.S.C. 154(b) by 0 days.

(21) Appl. No.: 15/953,906

(22) Filed: Apr. 16, 2018

(65) Prior Publication Data

US 2018/0302708 A1 Oct. 18, 2018

Related U.S. Application Data

(60) Provisional application No. 62/486,318, filed on Apr. 17, 2017.

(51) Int. Cl.

| | |
|---|---|
| ***H04R 1/10*** | (2006.01) |
| ***A43C 9/00*** | (2006.01) |
| ***H04R 5/033*** | (2006.01) |
| *A43C 7/00* | (2006.01) |
| *A44B 19/00* | (2006.01) |
| *A44B 18/00* | (2006.01) |
| *A44B 1/00* | (2006.01) |
| *A44B 17/00* | (2006.01) |

(52) U.S. Cl.

CPC ..... *H04R 1/1091* (2013.01); *A43C 9/00* (2013.01); *H04R 5/0335* (2013.01); *A43C 7/00* (2013.01); *A44B 1/00* (2013.01); *A44B 17/00* (2013.01); *A44B 18/00* (2013.01); *A44B 19/00* (2013.01); *A44D 2203/00* (2013.01); *H04R 1/10* (2013.01); *H04R 1/105* (2013.01)

(58) Field of Classification Search

CPC .. H04R 1/1008; H04R 1/1041; H04R 1/1016; H04R 1/1058; H04R 5/033; H04R 5/0335; H04R 1/1066; H04R 1/1075; H04R 1/1091

USPC ..... 381/370, 374, 376, 378

See application file for complete search history.

(56) References Cited

U.S. PATENT DOCUMENTS

| | | | | |
|---|---|---|---|---|
| 3,092,837 A * | 6/1963 | Austin | ..... | A42B 3/145 2/183 |
| 3,447,160 A * | 6/1969 | Teder | ..... | A61F 11/14 2/209 |
| 4,727,585 A * | 2/1988 | Flygstad | ..... | H04R 5/0335 2/209 |
| 6,724,906 B2 * | 4/2004 | Naksen | ..... | H04R 1/1066 381/370 |

(Continued)

FOREIGN PATENT DOCUMENTS

| | | |
|---|---|---|
| EP | 2986027 | 2/2016 |
| EP | 3143889 | 3/2017 |

OTHER PUBLICATIONS

Astro A40 Headset Instruction Manual, published about Jan. 2014 (9 Pages).

*Primary Examiner* — Oyesola C Ojo

(74) *Attorney, Agent, or Firm* — Knobbe, Martens, Olson & Bear, LLP

(57) ABSTRACT

Devices and apparatus of adjusting curvature of a headband of a headset are disclosed. Some embodiments include a stiffening frame that is flat or arcuate. The apparatus can include a holder that attaches the frame to the headband. The frame and the holder interact with a headband of a headset to adjust curvature of the headband.

15 Claims, 20 Drawing Sheets

(56) References Cited

U.S. PATENT DOCUMENTS

| | | | | |
|---|---|---|---|---|
| 8,050,444 | B2 * | 11/2011 | Smith | H04R 1/1066 381/370 |
| 9,137,598 | B2 * | 9/2015 | Chang | H04R 5/033 |
| 9,375,105 | B2 * | 6/2016 | Thomson | A47C 7/383 |
| 9,883,288 | B2 * | 1/2018 | Wallace | H04R 1/1066 |
| 9,980,048 | B2 * | 5/2018 | Henderson | H04R 5/0335 |
| 2012/0140974 | A1 * | 6/2012 | Danielson | H04R 1/1066 381/379 |
| 2014/0023222 | A1 * | 1/2014 | Ito | H04R 5/0335 381/379 |
| 2014/0263493 | A1 * | 9/2014 | Amurgis | H04R 5/0335 224/181 |
| 2016/0050486 | A1 * | 2/2016 | Uggla | H04R 1/1091 381/378 |
| 2016/0277828 | A1 * | 9/2016 | Oh | H04R 1/105 |
| 2017/0150771 | A1 * | 6/2017 | Huh | A42B 3/12 |
| 2017/0347194 | A1 * | 11/2017 | Nyegaard | H04R 1/1058 |
| 2017/0366892 | A1 * | 12/2017 | Wallace | H04R 1/1066 |
| 2018/0014973 | A1 * | 1/2018 | Echeverri | A61F 11/14 |
| 2018/0146292 | A1 * | 5/2018 | Wahlin | H04R 5/0335 |

* cited by examiner

HEADSET ACCESSORY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Technical Field

This disclosure is related generally to adjusting natural curvature of a headband of a headset. Some embodiments can include a stiffening frame having two ends and a body portion that is flat or substantially arcuate that operatively interact with a headband of a headset. Some embodiments can include a stiffening frame holder having a central section and at least two wings that serve to attach the holder to a headband of a headset.

Description of Related Art

This disclosure relates to headsets worn by gamers, entertainers, and professionals and to accessories that increase the comfort of such headsets. Gamers and entertainers can use headsets, such as, for example, virtual reality headsets, to listen, view, and/or communicate for recreational or professional use. Professionals can use headsets for data entry, telemarketing, audio production, video production, and various other tasks. Headsets includes a headphone, VR headset, or other types of headgears and can incorporate various types of earpieces such as earbuds, in-ear earpieces, on-ear earpieces, over-the-ear earpieces, close back over-ear earpieces, open back over-ear earpieces, or other types of earpieces. Some headsets may include a microphone and some may not. Some headsets may be double-earpiece and some others may be single-earpiece. Some headsets can provide a functionality of a telephone handset with a hands-free operation.

At least some headsets and headset accessories are uncomfortable to headset users. Such devices can include no padding or thin, unreliable padding on rigid portions of the devices. Prolonged use of a headset or headwear can give the user of the headset or headwear hotspots and uncomfortable pressure on areas where the headset contacts the head. In addition, hats and other headwear can generate discomfort when a rigid portion of the headwear (such as, for example, a button) is in contact with the head. The head locations where this contact occurs can be called hotspots or pressure points.

Therefore there is a need for an accessory for a headset that can be configured to satisfy the needs of gamers, consumers, and professionals while providing proper support. The accessory can provide cooling, comfort, and/or anti-hotspot functionality when used with a headset, so the user can feel the full experience and longevity of the headset.

SUMMARY

Accordingly, some embodiment provides an apparatus for adjusting a curvature of a headset headband, the apparatus comprising: a stiffening frame comprising a first end, a second end opposite the first end, wherein a length of the stiffening frame is a distance between the first end and the second end, and a body portion extending between the first end and the second end, wherein the body portion has a width, a thickness, and a cross-sectional area, wherein the body portion is made of a material with a first Young's modulus, and wherein the body portion has an axial stiffness equal to a product of the cross-sectional area and the first Young's modulus divided by the length; and a stiffening frame holder configured to releasably attach the stiffening frame to a headband of a headset, wherein the stiffening frame is configured to adjust a natural curvature of the headband.

Some embodiment includes a stiffening frame for adjusting a natural curvature of a headband of a headset, the stiffening frame configured for releasable attachment to the headband, wherein the headband is configured to extend at least a portion of a wearer of the headset, the stiffening frame comprising: a first end; a second end opposite the first end, wherein a length of the stiffening frame is a distance between the first end and the second end; a body portion having a top surface and a bottom surface, wherein the top surface has a first curvature associated with a first radius of curvature, and wherein the bottom surface has a second curvature associated with a second radius of curvature; and an stiffening frame connector configured to releasably attach the stiffening frame to the headband of the headset.

Another embodiment provides a stiffening frame holder configured to attach a stiffening frame to a headband of a headset, wherein the headband has a natural curvature, and wherein the stiffening frame is configured to adjust a natural curvature of the headband, the stiffening frame holder comprising: a center section comprising a pocket made out of a flexible material, wherein the pocket has dimensions that are sufficient for at least one stiffening frame to be disposed therein, wherein the center section comprises a first longitudinal periphery and a second longitudinal periphery extending between a first end and a second end of the center section, and wherein the center section comprises a first transverse periphery and a second transverse periphery extending between a first side and a second side of the center section; a first wing connected to the first side of the center section, wherein the first wing has a transverse width corresponding to a distance from the first side of the center section to an outer edge of the first wing, and wherein the transverse width of the first wing is greater than a distance between the first side and the second side of the center section, the first wing rotatably foldable towards the second wing with respect to a first longitudinal axis defined by the first side of the center section; a second wing operatively connected to the second side of the center section, wherein the second wing has a transverse width corresponding to a distance from the second side of the center section to an outer edge of the second wing, and wherein the transverse width of the second wing is substantially same as the distance between the first side and the second side of the center section, the second wing rotatably foldable towards the first wing with respect to a second longitudinal axis defined by the second side of the center section; a first attachment apparatus connected to the first wing; a second attachment apparatus connected to the second wing; and wherein when the first wing is folded towards the second wing and the second wing is folded towards the first wing, the first attachment apparatus and the second attachment apparatus operatively interacts to releasably attach the stiffening frame holder to the headband; and wherein the interaction between the first attachment apparatus of the first wing and the second attachment apparatus of the second wing adjusts the natural curvature of the headband.

DETAILED DESCRIPTION OF CERTAIN EMBODIMENTS

Figure 1:
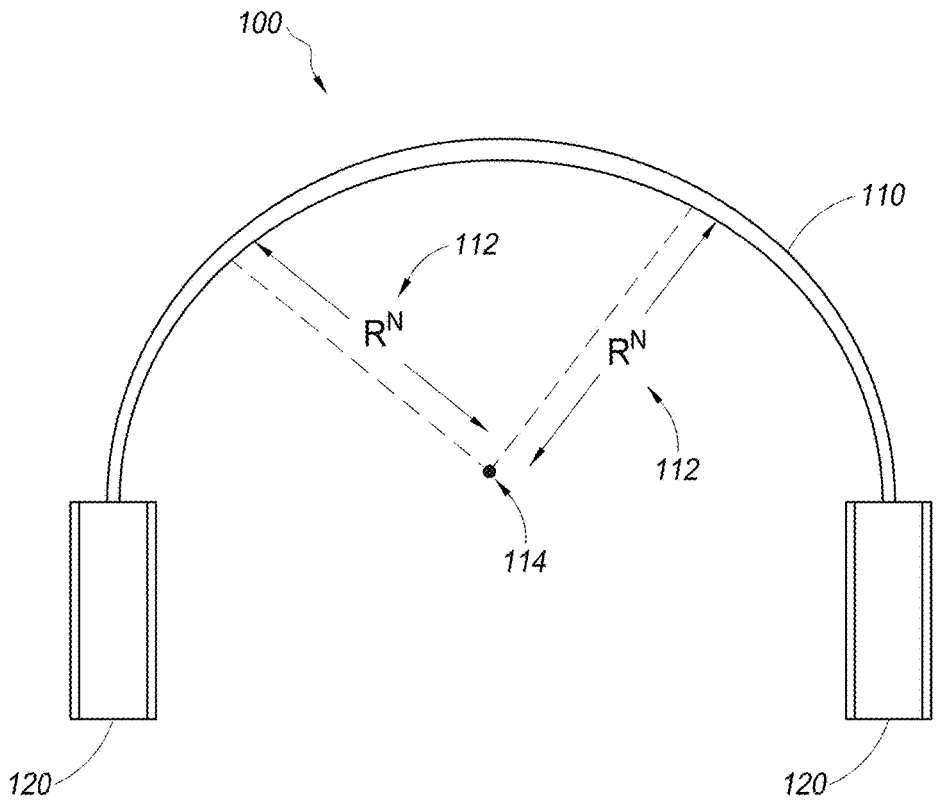
FIG. 1 is an illustration showing a headset with a headband and two earpieces.

FIG. 1 is an illustration showing a headset 100. The headset 100 comprises a headband 110 and two earpieces 120. The headband 110 and the two earpieces 120 are operatively connected so that the earpieces 120 covering ears of a wearer are spaced from each other at a certain distance. The headband 110 covers at least a portion of the wearer's head and is mechanically connected to each of the two earpieces 120. When placed on the wearer's head, the headset 100 and its headband 110 will have a natural curvature around the wearer's head. The natural curvature of the headset 100 is defined by natural radius 112 of curvature and natural center 114 of curvature, as shown in FIG. 1. In some embodiments, the headset 100 has headband 110 that is substantially arcuate throughout. In some other embodiments, the headband 110 has at least one portion that is substantially straight or substantially not arcuate. The natural curvature of a headband 110 of a headset 100 can be determined using the entire portion of the headband 110 or a portion of the headband 110. In some embodiments, the natural curvature is determined from a portion of the headband 110 that is substantially covered by a stiffening frame 200 (FIGS. 9A, 9B, 9C, and 10).

Figure 2B:
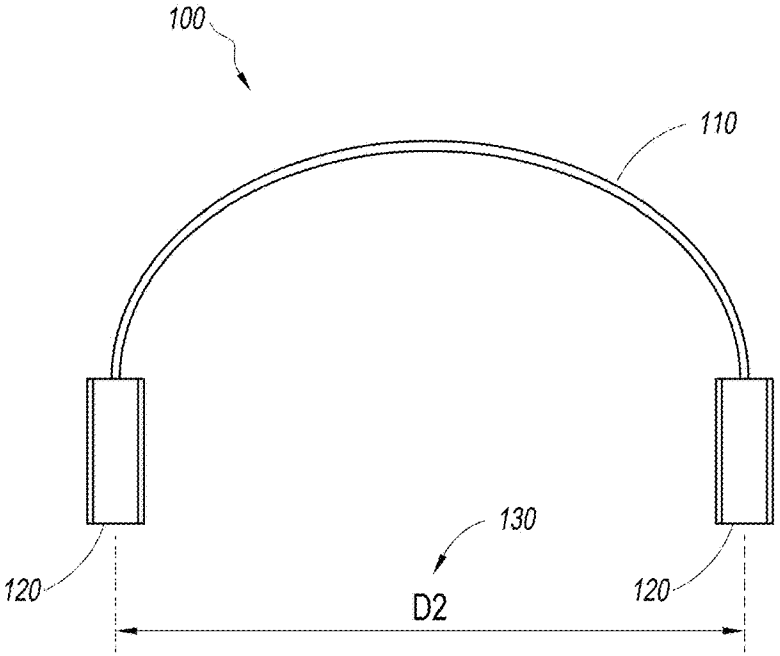
FIG. 2B is an illustration showing a second headset with a second distance between its earpieces.
Figure 2A:
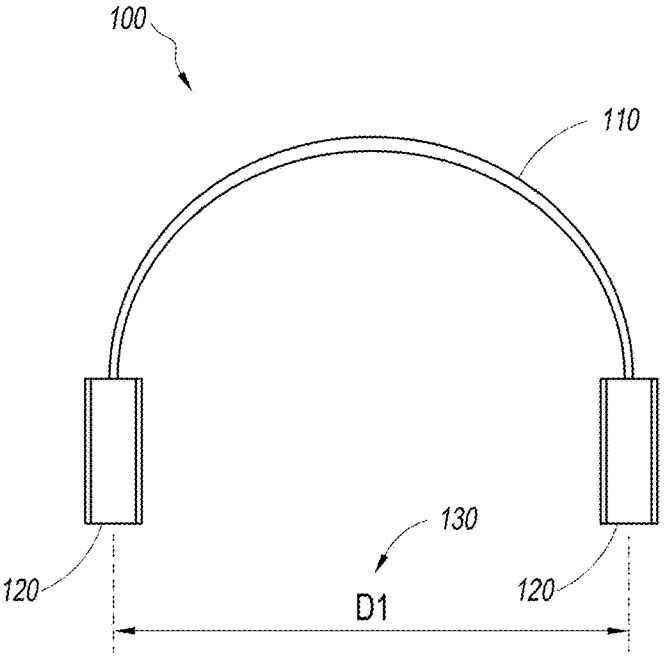
FIG. 2A is an illustration showing a first headset with a first distance between its earpieces.

FIGS. 2A and 2B are illustrations showing two headsets 100. In FIG. 2A, a headset 100 has two earpieces 120 that are separated at a distance D1. In FIG. 2B, a headset 100 has earpieces 120 that are separated at a distance D2. Depending on the size of a wearer of a headset, the distance 130 between the earpieces 120 can vary. This varying distance 130 between the earpieces 120 can generate pressure, which in turn can create some discomfort for the wearer. Depending on the distance 130 between the earpieces 120, natural curvature of the headband 110 will differ. For example, natural curvature of the headband 110 of the headset 100 shown in FIG. 2A will have a natural radius 112 of curvature that is greater than the headband 110 of the headset 100 shown in FIG. 2B.

Figure 3A:
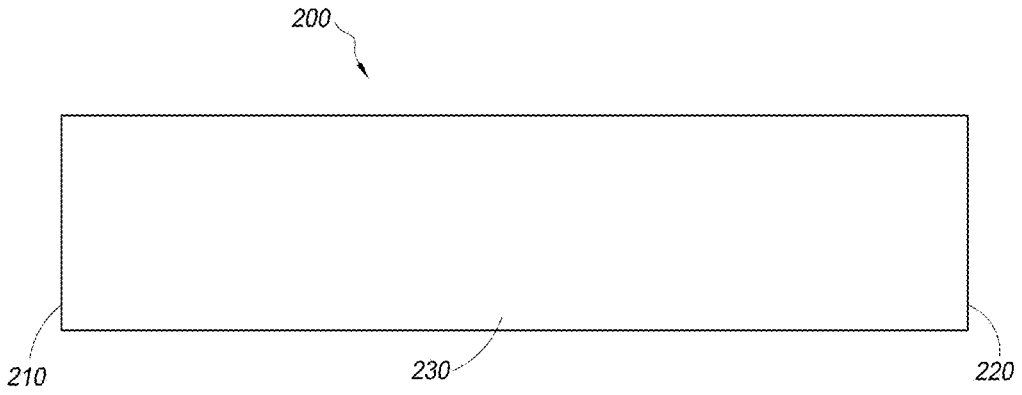
FIG. 3A is a top view of an embodiment of a stiffening frame.

FIG. 3A is a top view of an embodiment of a stiffening frame 200. The stiffening frame 200 comprises a first end 210, a second end 220, and a body portion 230 that defines a portion of the stiffening frame 200 that is between the first end 210 and the second end 220. The first end 210, the second end 220, and the body portion 230 are connected to each other so that the body portion 230 is situated between the first end 210 and the second end 220. In some embodiments, the stiffening frame 200 has a top surface facing away from the headband 110 and a bottom surface facing the headband 110. In some embodiments, the top surface of the stiffening frame 200 has a first curvature, and the bottom surface of the stiffening frame 200 has a second curvature. The respective curvatures of the top and the bottom surface of the stiffening frame 200 may have same or different radius of curvature. The stiffening frame 200 can have a uniform thickness from the first end 210 to the second end 220. In some embodiments, the stiffening frame stiffening frame 200 can have the body portion 230 having different thickness at various locations.

Figure 3B:
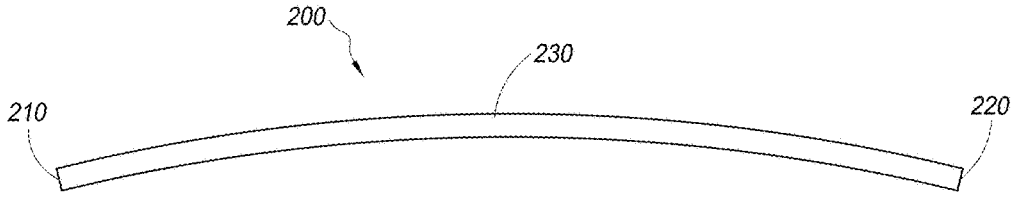
FIG. 3B is a front view of the stiffening frame shown in FIG. 3A.
Figure 10:
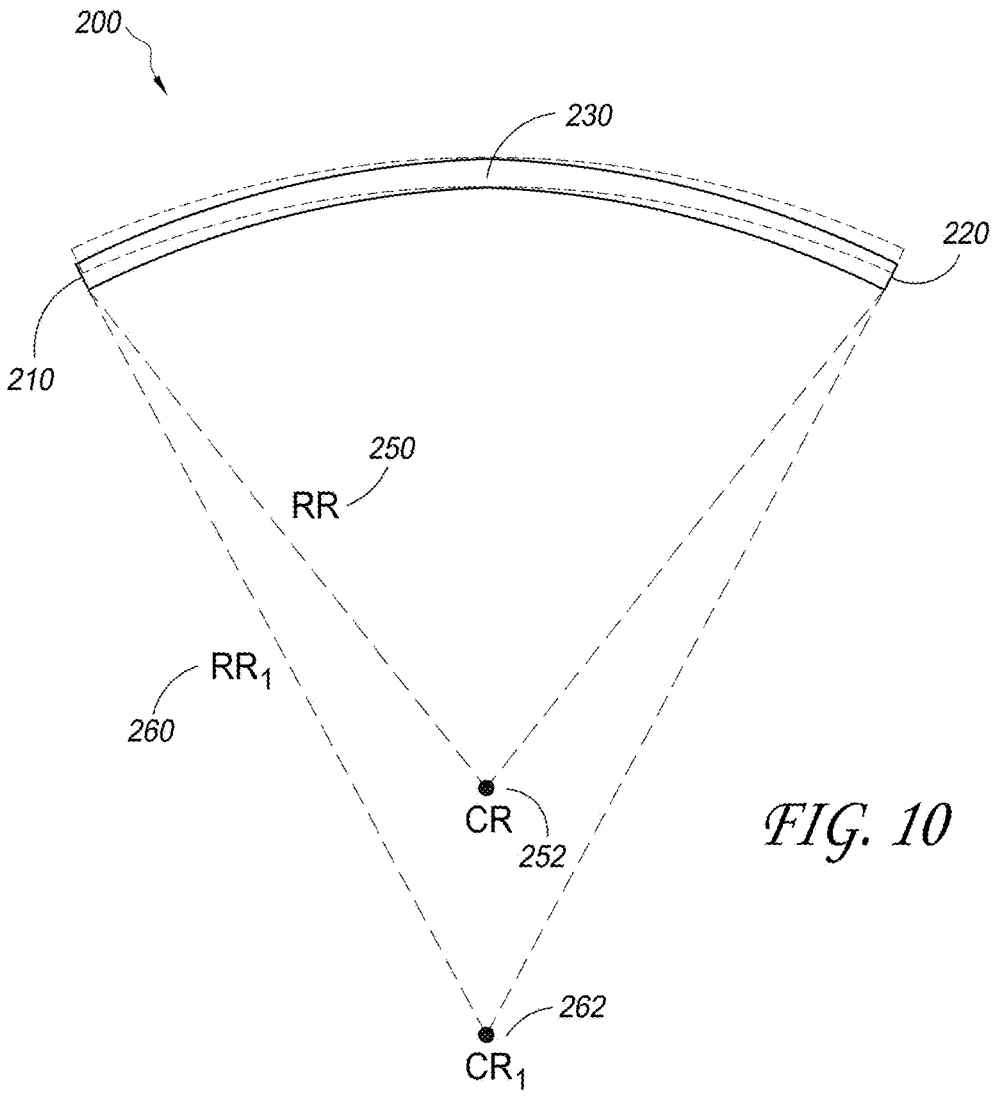
FIG. 10 is a side view of a stiffening frame illustrating one method of changing resting curvature of the stiffening frame.
Figure 11:
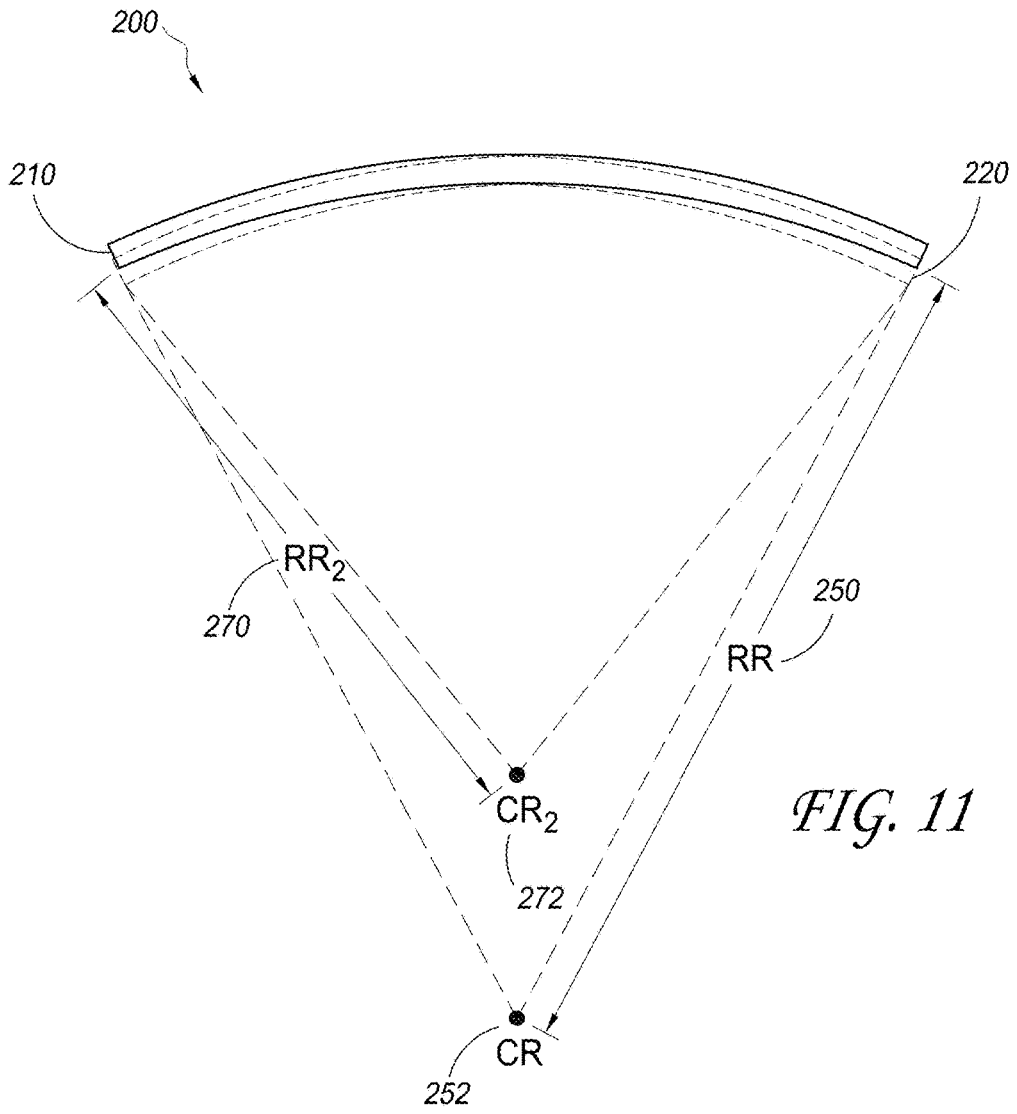
FIG. 11 is a side view of a stiffening frame illustrating another method of changing resting curvature of the stiffening frame.

FIG. 3B is a front view of the stiffening frame shown in FIG. 3A. The body portion 230 may be flat, or substantially flat or arcuate so that it has a resting curvature, as shown in FIG. 3B. As shown in FIG. 10, the stiffening frame 200 has a resting curvature that is defined by a resting radius 250 ($R_R$) of the resting curvature and a resting center 252 ($C_R$) of the resting curvature. The resting curvature of the stiffening frame 200 can change when force is applied to the stiffening frame 200. For example, the resting curvature of the stiffening frame 200 may change to a first curvature as shown in FIG. 10. The first curvature of the stiffening frame 200 is defined by of a first radius 260 ($R_{R1}$) of the first curvature and a first center 262 ($C_{R1}$) of the first curvature. The location of the resting center 252 is different from that of the first center 262, and the first radius 260 of the stiffening frame 200 is less than the resting radius 250 of the stiffening frame 200. In some embodiments, the resting curvature of the stiffening frame 200 may change to a second curvature as shown in FIG. 11. The second curvature of the stiffening frame 200 is defined by of a second radius 270 ($R_{R2}$) of the second curvature and a second center 272 ($C_{R2}$) of the second curvature. The location of the resting center 252 is different from that of the second center 272, and the second radius 270 of the stiffening frame 200 is greater than the resting radius 250 of the stiffening frame 200.

In some embodiments, the stiffening frame 200 is made out of a flexible, yet strong material that is bendable. For example, the stiffening frame 200 can made out of, but not limited to, nylon polymer, acrylic, or carbon fiber. In some other embodiments, various parts of the stiffening frame 200 may be made out of different materials having different Young's modulus. For example, portions nearby the first end 210 and the second end 220 of the stiffening frame 200 may be made from a material different from material used for the body portion 230. In some embodiments, the stiffening frame 200 may be foldable.

Figure 3C:
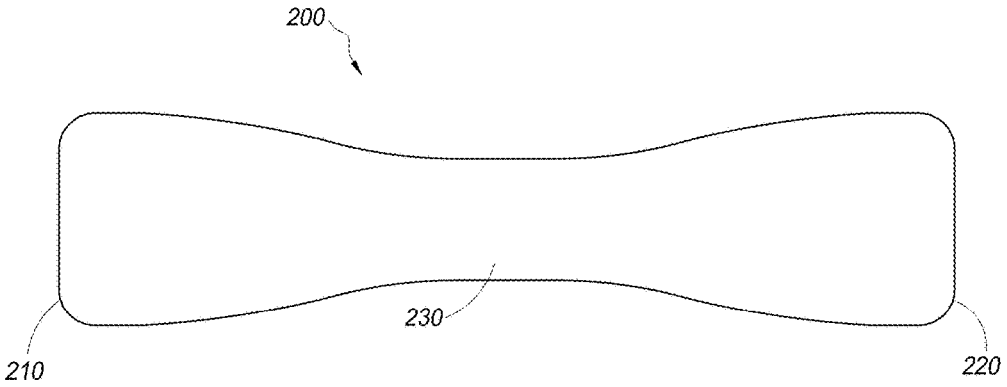
FIG. 3C is a top view of another embodiment of a stiffening frame.
Figure 3D:
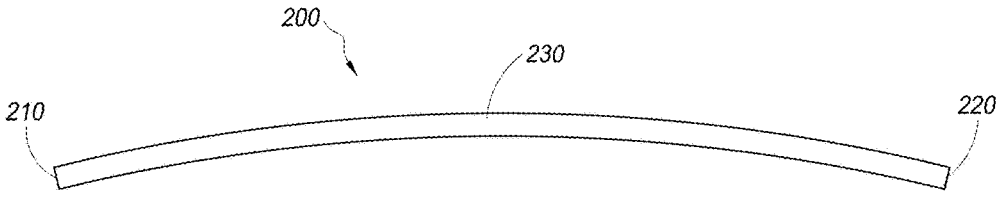
FIG. 3D is a front view of the stiffening frame shown in FIG. 3C.

FIG. 3C is a top view of another embodiment of a stiffening frame 200 having a first end 210, a second end 220, and a body portion 230. As shown in FIG. 3C, the body portion 230 has a width that is smaller than widths of the first end 210 and the second end 220. In some other embodiments, the width of the body portion 230 may be greater than that of the first end 210 and the second end 220. Edges operatively and mechanically connecting the first end 210 to the body portion 230 may be smooth and curved as shown in FIG. 3C. Likewise, edges operatively and mechanically connecting the second end 220 to the body portion 230 may also be smooth and curved. As shown in FIG. 3D, the embodiment of the stiffening frame 200 as shown in FIG. 3C may be curved as a certain resting curvature. Said resting curvature may be adjusted as described above and such adjustment will not be discussed herein.

Figure 3E:
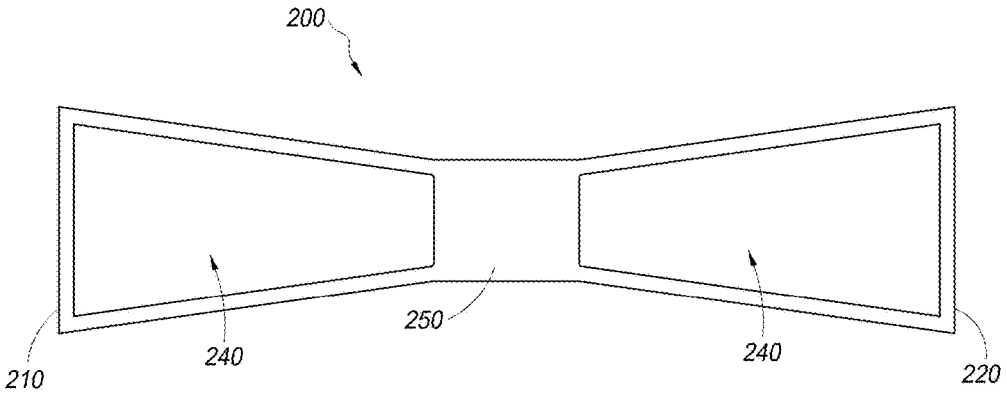
FIG. 3E is a top view of another embodiment of a stiffening frame.
Figure 3F:
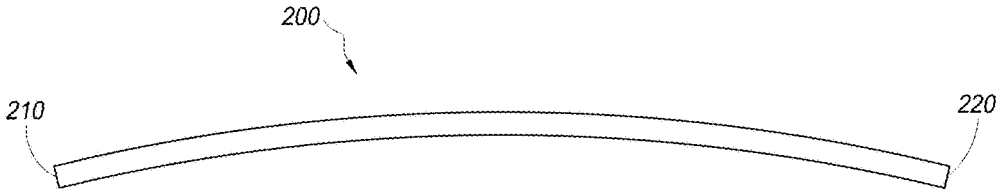
FIG. 3F is a front view of the stiffening frame shown in FIG. 3E.

FIG. 3E is a top view of another embodiment of a stiffening frame 200 having a first end 210, a second end 220, a body portion 230, and openings 240. As shown in FIG. 3E, the body portion 230 has a width that is smaller than widths of the first end 210 and the second end 220. In some other embodiments, the width of the body portion 230 may be greater than that of the first end 210 and the second end 220. Edges operatively and mechanically connecting the first end 210 to the body portion 230 may not be smooth and curved. Likewise, edges operatively and mechanically connecting the second end 220 to the body portion 230 may also not be smooth and curved. The stiffening frame 200 may have openings 240 situated in areas between the body portion 230 and the first end 210, and in areas between the body portion 230 and the second end 220. In some embodiments, there may be more than two openings 240. Arrangement of the openings 240 may be symmetrical. In some embodiments, the arrangement of the openings 240 may asymmetrical. As shown in FIG. 3F, the embodiment of the stiffening frame 200 as shown in FIG. 3E may be curved as a certain resting curvature. Said resting curvature may be adjusted as described above and such adjustment will not be discussed herein.

Figure 4A:
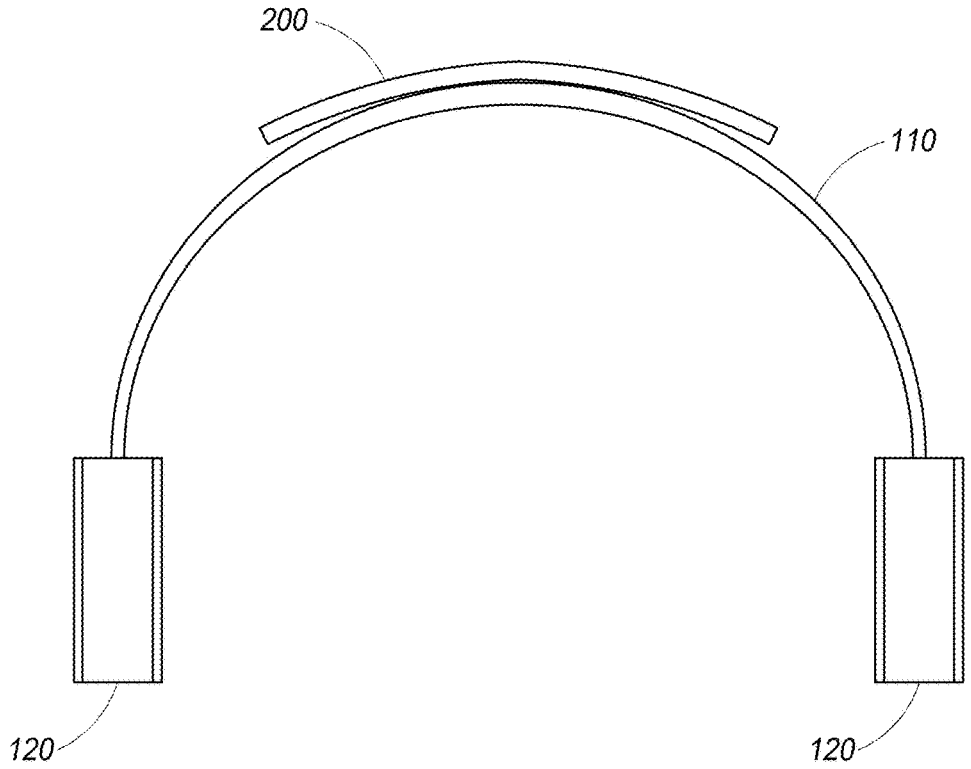
FIG. 4A is a front view of a headset with a headband and two earpieces, incorporating an embodiment of a stiffening frame.

FIG. 4A is a front view of an embodiment including a headset 100 with a headband 110 and two earpieces 120, the embodiment further comprising a stiffening frame 200. The stiffening frame 200 is placed on top of the headband 110 and may be releasably attached to the headband 110 of the headset 100 via different types of attachment methods as described below in the specification. In some embodiments, the stiffening frame 200 is placed on top of the headband 110 while in some embodiments, the stiffening frame 200 is placed below the headband 110 so that the stiffening frame 200 is located between the headband 110 and a wearer's head. The stiffening frame 200 may cover substantial portion of the headband 110 of the headset 100. In some embodiments, the stiffening frame may cover entire portion of the headband 110. In some embodiments, the stiffening frame may cover between 5% and 100% of the arc length of the headband 110.

Figure 4B:
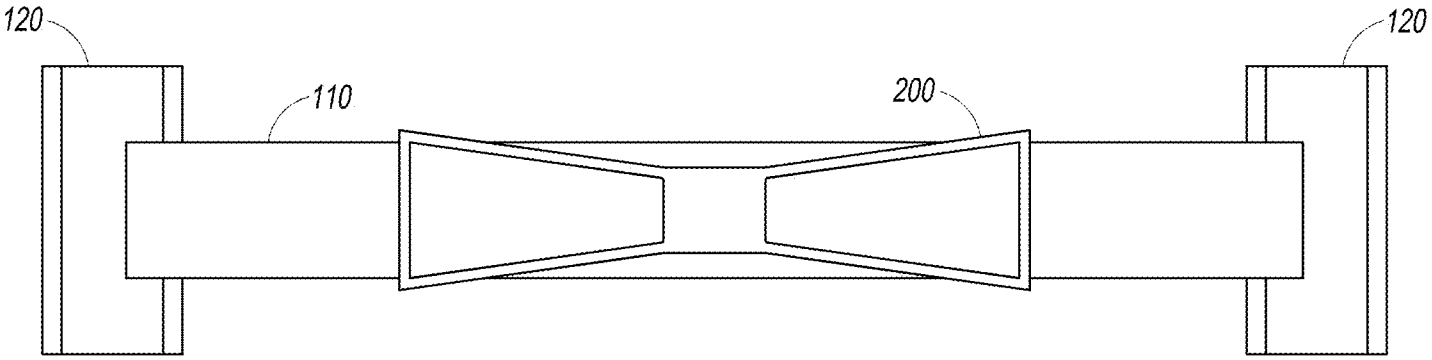
FIG. 4B is a top view of the headset shown in FIG. 4A.

FIG. 4B is a top view of the headset 100 with the stiffening frame 200 shown in FIG. 4A. Other types of embodiments of the stiffening frame 200 may be used in conjunction with the headband 110 of the headset 100. As described above the stiffening frame 200 may comprise of a first end 210, a second end 220, and a body portion 230. As shown in FIG. 4B, the stiffening frame 200 may also comprise of at least one opening 240 that may be symmetrical in some embodiments and asymmetrical in other embodiments. Widths of the first end 210 and the second end 220 may be greater than width of the first end 210 as shown in FIG. 4B. In some embodiments, the widths of the first end 210 and second end 220 may be substantially similar to that of the headband 110 or be smaller than the width of the headband 110. The stiffening frame 200 may be placed on top of the headband 110 so that the center portion of the stiffening frame 200 substantially aligns with the center of the headband 110 with respect to the earpieces 120. In some embodiments, the first end 210 and the second end 220 may be spaced apart from the headband 110, whereas substantially middle portion of the body portion 230 of the stiffening frame 200 will operatively be in contact with the headband 110. In some other embodiments, the first end 210 and the second end 220 may be in contact with the headband 110, whereas the substantially middle portion of the body portion 230 of the stiffening frame 200 may be spaced apart from the headband 110.

Figure 5A:
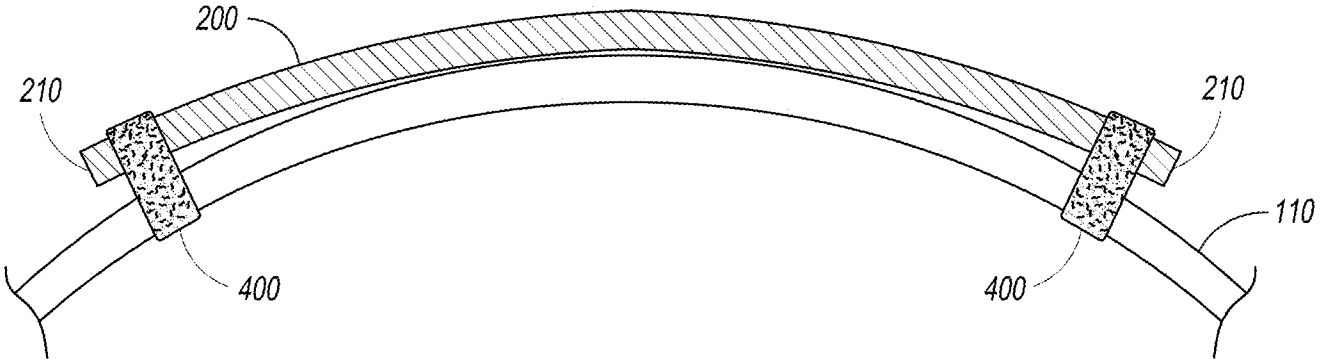
FIG. 5A is a front view of an embodiment of a stiffening frame and a stiffening frame holder.

FIG. 5A is a front view of an embodiment of a stiffening frame 200 and a stiffening frame holder 400. The stiffening frame 200 is disposed on top of the headband 110 so that it is substantially located at the center portion of the headband 110. Top surface of the stiffening frame 200 faces away from the headband 110 and bottom surface of the stiffening frame 200 faces the headband 110. In some embodiments, the top surface of the stiffening frame 200 has a first curvature, and the bottom surface of the stiffening frame 200 has a second curvature. The respective curvatures of the top and the bottom surfaces of the stiffening frame 200 may have same or different radius of curvature.

Figure 5B:
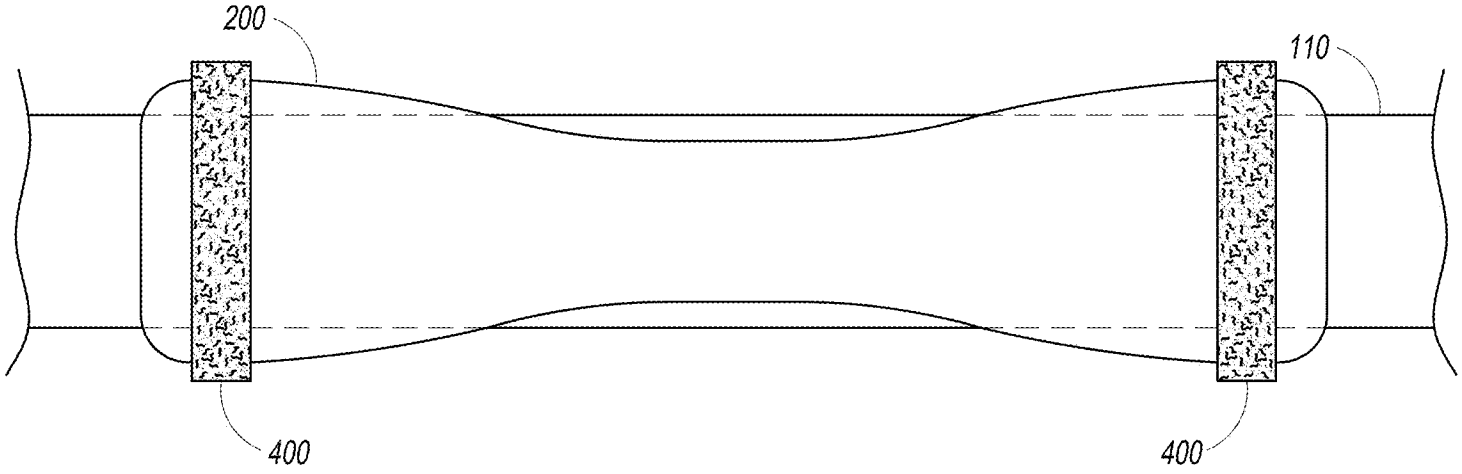
FIG. 5B is a top view of the stiffening frame and the stiffening frame holder shown in FIG. 5A.

In some embodiments, the stiffening frame 200 may be placed under the headband 110 so that the stiffening frame 200 is placed between the headband 110 and a wearer's head. At least one stiffening frame holder 400 is used to releasably attach the stiffening frame 200 to the headband 110. Some embodiments of the stiffening frame holder 400 are configured to fasten and secure the stiffening frame 200 to the headband 110 using but not limited to, a hook and loop system, buttons, snaps, a zipper, magnets, and/or a lacing loop system. The stiffening frame holder 400 may be configured so that they are slidable along the arcuate length of the stiffening frame 200. Closer the at least one stiffening frame holders 400 to the first end 210 and the second end 220 of the stiffening frame 200, more force will be exerted on the headband 110 of the headset 100 so that the change of the curvature of the headband 110 will be greater. FIG. 5B is a top view of the stiffening frame 200 and the stiffening frame holder 400 shown in FIG. 5A.

Figure 6:
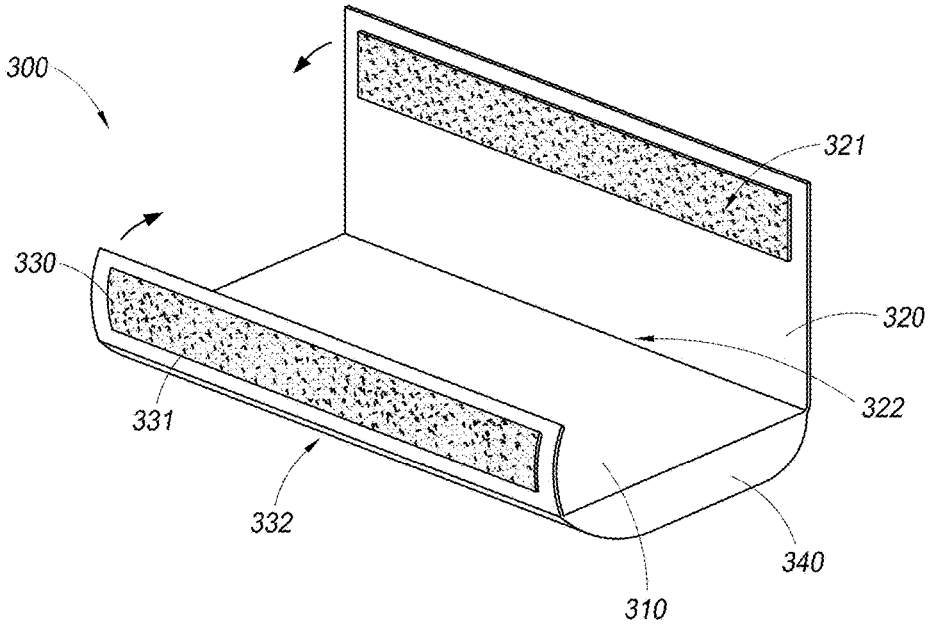
FIG. 6 is a perspective view of an embodiment of a stiffening frame holder with its side portions in open and close configurations.
Figure 6:
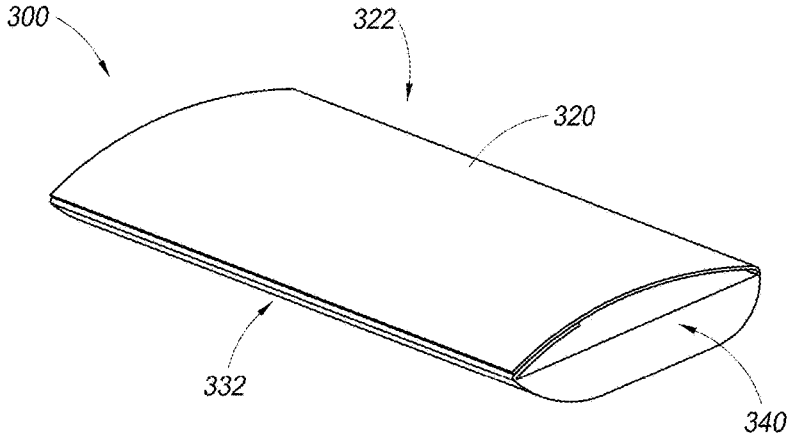

FIG. 6 shows a perspective view of an embodiment of a stiffening frame holder 300 with its wings in an open configuration. The stiffening frame holder 300 comprises a center section 310, a first wing 320, and a second wing 330. The center section 310 comprises at least one pocket 340. The first wing 320 comprises a first fastening apparatus 321 and a first folding region 322. The second wing 330 comprises a second fastening apparatus 331 and a second folding region 322. The stiffening frame holder 300 may be made from one or more materials, including but not limited to, for example, nylon, polyester, acrylic, leather, rayon, microfiber, vinyl, olefin, cotton, wool, suede, flannel, denim, natural and synthetic fibers, various radiant heating, comfort and/or cooling fabrics. Dimensions of the stiffening frame holder 300 can range from 1 inch to 30 inches in length and 1 inch to 30 inches in width.

In some embodiments, the center section 310 comprises a first longitudinal periphery and a second longitudinal periphery extending between a first end and a second end of the center section, and wherein the center section comprises a first transverse periphery and a second transverse periphery extending between a first side and a second side of the center section 310. The at least one pocket 340 can be made out of a flexible material, wherein the pocket 340 has dimensions that are sufficient for at least one stiffening frame 200 to be disposed therein. The pocket 340 can be made out a material that is different from the stiffening frame holder 300. The at least one pocket 340 can also house at least one padding. The at least one padding can be disposed within the stiffening frame holder 300 so that when the stiffening frame holder 300 wraps around a headband 110 of a headset 100, the padding also wraps around at least a portion of the pocket 340 or the at least one stiffening frame 200 disposed in the at least one pocket 340. In some embodiments, the padding is disposed in the center section 310, the first wing 320, and the second wing 330. However, the padding can also be disposed just the first wing 320 and the second wing 330. The padding can also be disposed in either one of the first wing 320 and the second wing 330. The padding can also be disposed only in the center section 310 of the stiffening frame holder 300.

In some embodiments, the first wing 320 is connected to the first side of the center section 310, wherein the first wing 320 has a transverse width corresponding to a distance from the first side of the center section 310 to an outer edge of the first wing 320, and wherein the transverse width of the first wing 320 is greater than a distance between the first side and the second side of the center section 310. In some embodiments, the first wing 320 has a longitudinal length that is less than the distance between the first end and the second end of the center section 310. In some other embodiments, the first wing 320 has a longitudinal length that is greater than the distance between the first end and the second end of the center section 310. The second wing 330 is connected to the second side of the center section 310, wherein the second wing 330 has a transverse width corresponding to a distance from the second side of the center section 310 to an outer edge of 330, and wherein the transverse width of the second wing 330 is substantially same as the distance between the first side and the second side of the center section 310. In some embodiments, the second wing 330 has a longitudinal length that is less than the distance between the first end and the second end of the center section 310. In some other embodiments, the second wing 330 has a longitudinal length that is greater than the distance between the first end and the second end of the center section 310.

FIG. 6 also shows a perspective view of the stiffening frame holder 300 with its wings in a closed configuration. As noted above, the first wing 320 is connected to the first fastening apparatus 321 and the second wing 330 is connected to the second fastening apparatus 331. In some embodiments, the first fastening apparatus 321 is a male fastening apparatus and the second fastening apparatus 331 is a female fastening apparatus. In some other embodiments, the first fastening apparatus 321 is a female fastening apparatus and the second fastening apparatus 331 is a male fastening apparatus. The first fastening apparatus 321 and the second fastening apparatus 331 are positioned on the first wing 320 and the second wing 330, respectively, so that when the first wing 320 and the second wing 330 are folded towards the center section 310, the first fastening apparatus 321 and the second fastening apparatus 331 interact with one another to attach the stiffening frame holder 300 to a headband 110 of a headset 100. Some embodiments of the first fastening apparatus 321 and the second fastening apparatus 331 are configured use but not limited to, a hook and loop system, Velcro, buttons, snaps, a zipper, magnets, and/or a lacing loop system.

Figure 7:
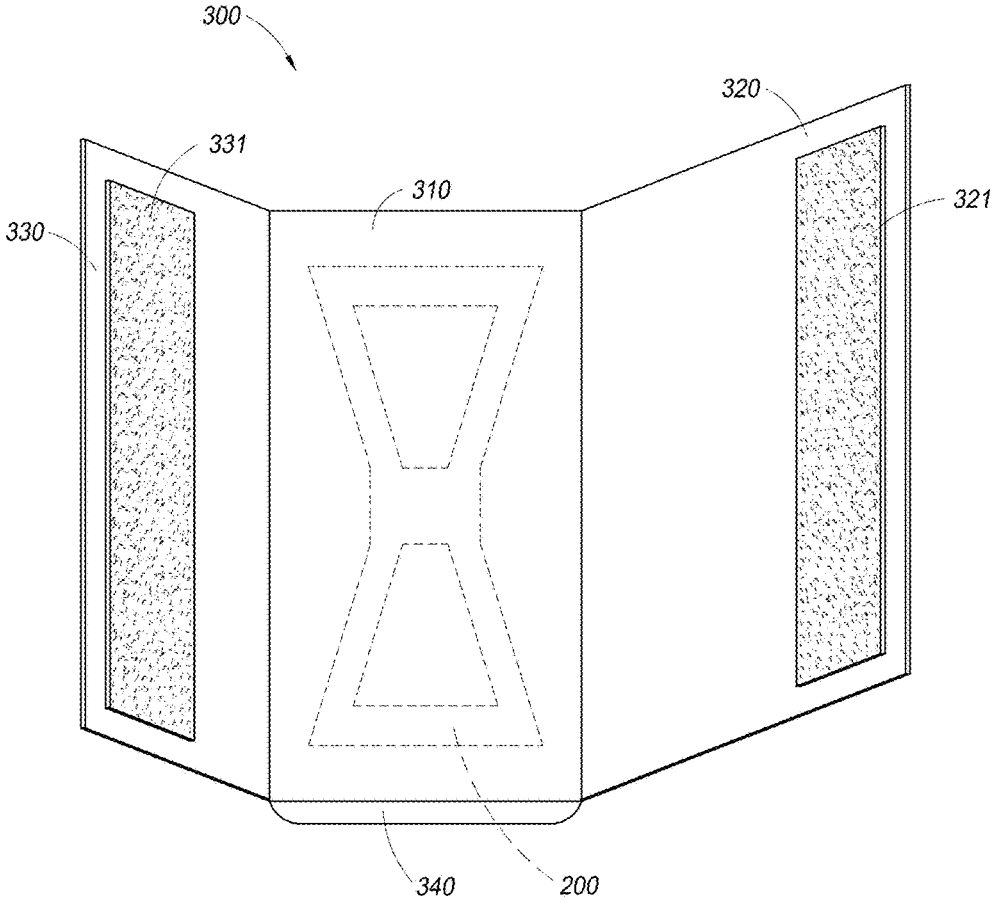
FIG. 7 is an illustration of an embodiment of a stiffening frame holder and a stiffening frame placed inside the stiffening frame holder.

FIG. 7 is an illustration of an embodiment of a stiffening frame holder 300 and a stiffening frame 200 placed within the stiffening frame holder 300. The stiffening frame 200 is placed inside the pocket 340 of the stiffening frame holder 300.

Figure 8:
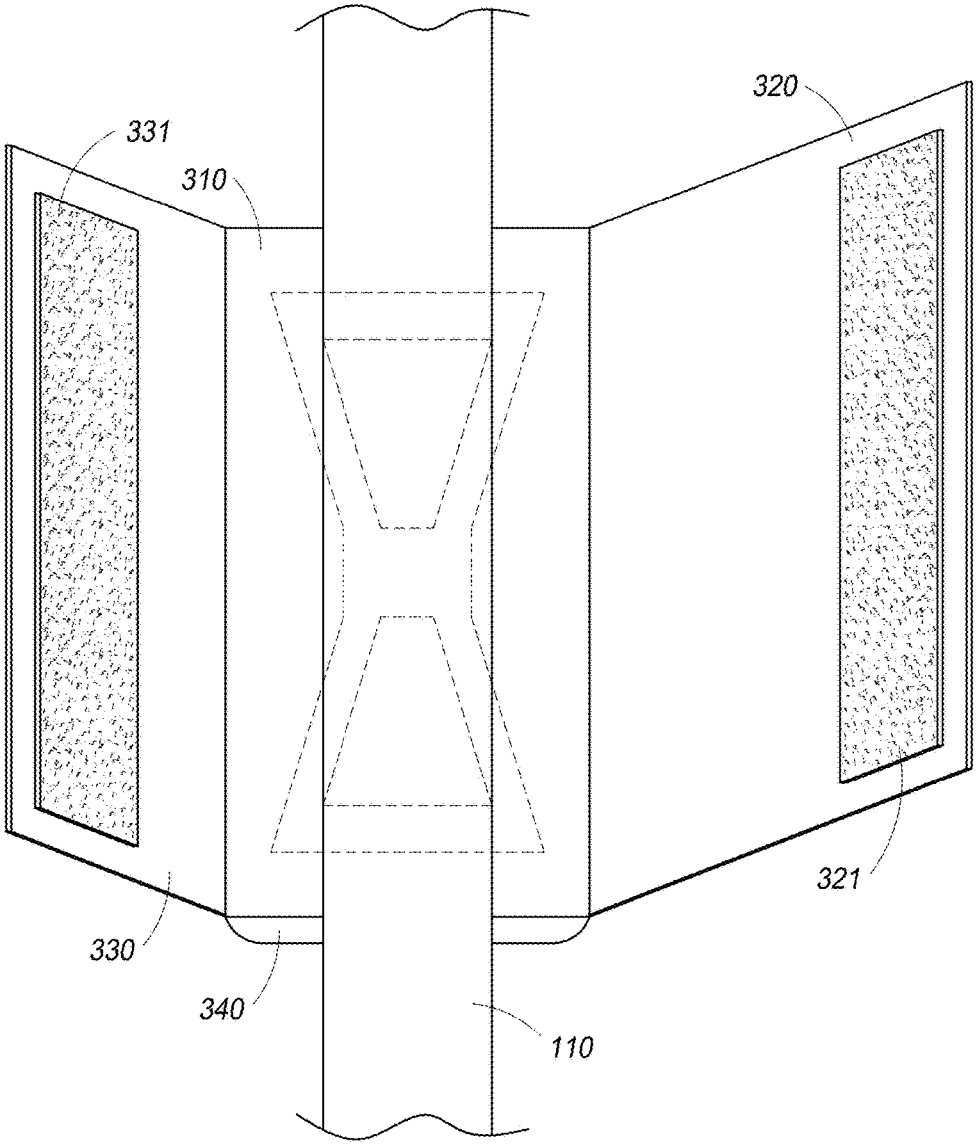
FIG. 8 is an illustration of a headband of a headset and an embodiment of a stiffening frame holder with a stiffening frame placed therein.

FIG. 8 is an illustration showing an embodiment of a stiffening frame holder 300 with a stiffening frame 200 placed within a pocket 340 of the stiffening frame holder 300. Here, the stiffening frame holder 300 is placed so that a headband 110 of a headset 100 is placed between a wearer's head and the stiffening frame holder 300. In this configuration, the stiffening frame 200 placed inside the pocket 340 of the stiffening frame holder 300 is also located so that the headband 110 is located between the stiffening frame 200 and the wearer's head. The center section 310 of the stiffening frame holder 300 faces the headband 110. Once the stiffening frame holder 300 is placed on the headband 110, a first wing 320 and a second wing 330 of the stiffening frame holder 300 will be folded against the center section 310, as shown in FIG. 6. As discussed above, a first fastening apparatus 321 connected to the first wing 320 and a second fastening apparatus 331 connected to the second wing 330 will interact so that the stiffening frame holder 300 is releasably attached to the headband 110.

Figure 9A:
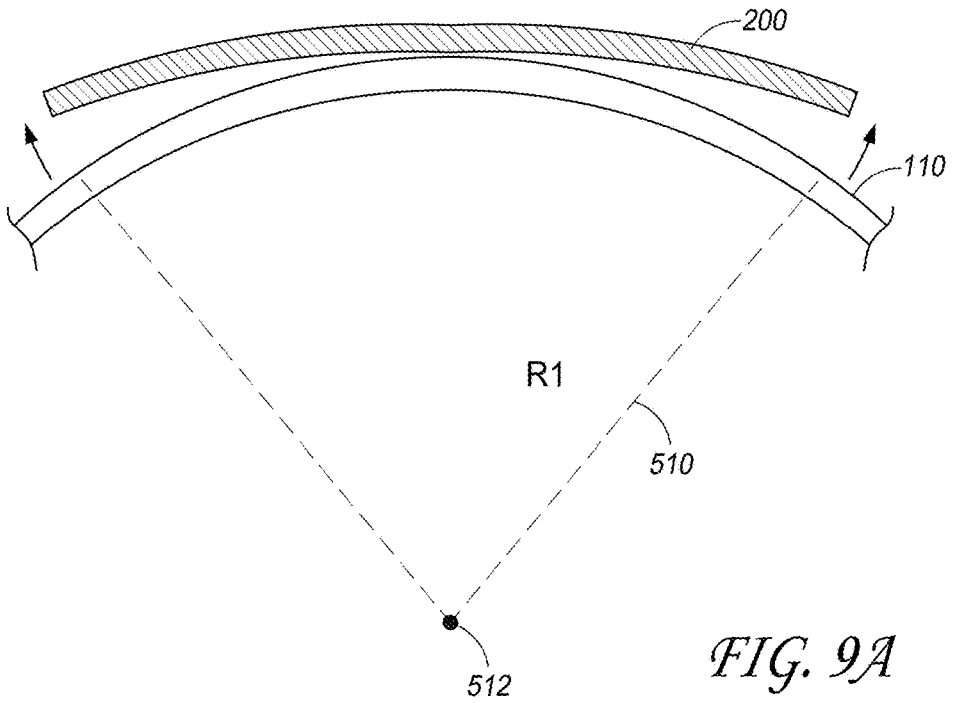
FIG. 9A is a side view of a headband and a stiffening frame with the headband having its natural curvature.

FIG. 9A is a side view of a stiffening frame 200 placed on a headband 110 so that the headband 110 will be placed between the stiffening frame 200 and a wearer's head. Without a stiffening frame holder 400 (shown in FIG. 9B), the headband 110 has a natural curvature. The natural curvature of the headband 110 is associated with a first radius 510 (R1) and a first center 512 (C1) of curvature.

Figure 9B:
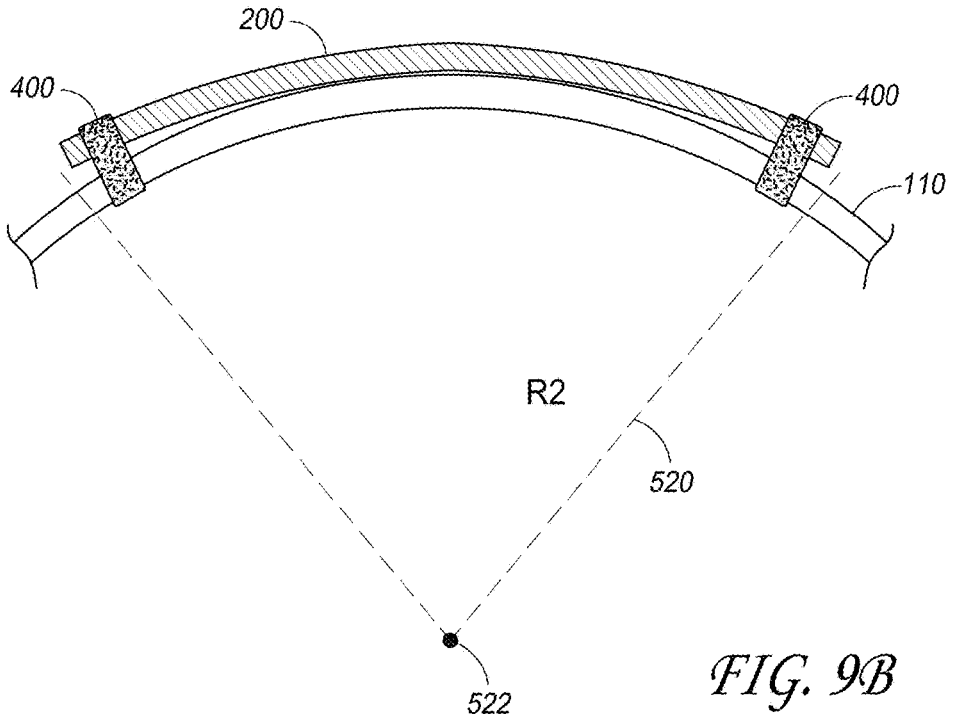
FIG. 9B is a side view of the headband and the stiffening frame shown in FIG. 9A along with an embodiment of a stiffening frame holder, and the headband having an adjusted curvature.
Figure 9C:
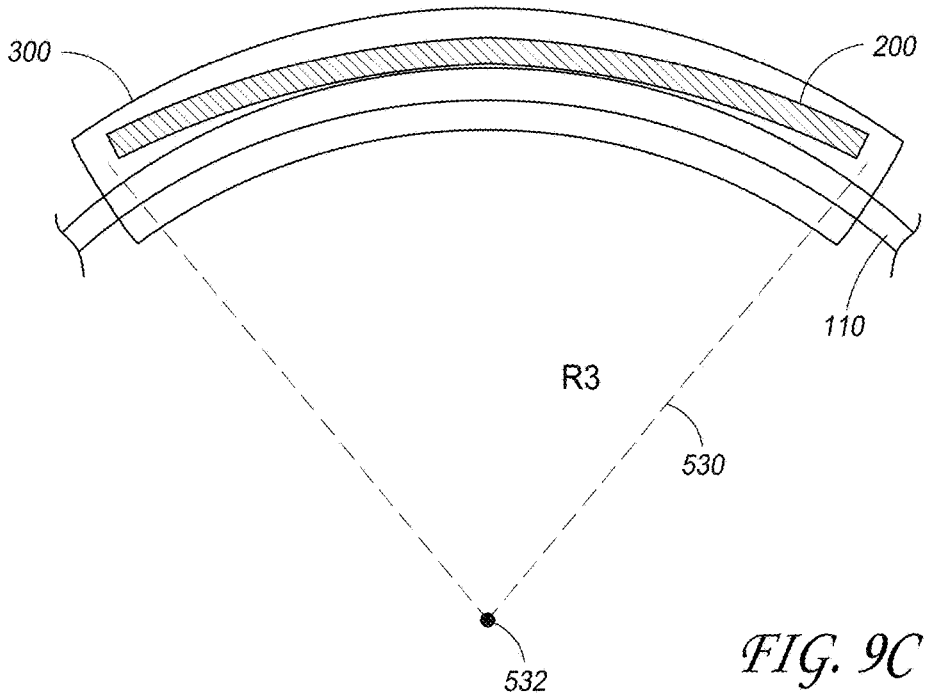
FIG. 9C is a side view of the headband and the stiffening frame shown in FIG. 9A along with another embodiment of a stiffening frame holder, and the headband having an adjusted curvature.

When at least one stiffening frame holder 400 is connected to the stiffening frame 200 and the headband 110, the curvature of the headband 110 changes to a second curvature. The second curvature associated with a second radius 520 (R2) and a second center 522 (C2), as shown in FIG. 9B. A change of curvature of the headband 110 can vary depending on the type of stiffening frame holder used. FIG. 9C illustrates a different stiffening frame holder 300 used in conjunction with the headband 110 and the stiffening frame 200. The stiffening frame holder 300 shown in FIG. 9C is one similar to the stiffening frame holder shown in FIG. 6. With stiffening frame holder 300, the curvature of the headband 110 changes to a third curvature, where the third curvature is associated with a third radius 530 (R3) and a third center 532 (C3). The stiffening frame holders in various embodiments may cover a substantial portion of the stiffening frame 200. In some embodiments, the stiffening frame holders may cover a substantial portion of the headband 110. In some embodiments, the stiffening frame holders may cover between 5% and 100% of the headband 110.

FIGS. 10 and 11 show two ways a stiffening frame 200 may be deflected. In both FIGS. 10 and 11, the stiffening frame 200 has a resting curvature associated with a resting radius 250 ($R_R$) of curvature and a resting center 252 ($C_R$) of curvature. As one with ordinary skill in the art would appreciate, as the stiffening frame 200 becomes less arcuate as shown in FIG. 10, assuming that the length of the stiffening frame 200 remains the same, radius of curvature of the stiffening frame 200 will increase. On the other hand, if the stiffening frame 200 becomes more arcuate as shown in FIG. 11, radius of curvature of the stiffening frame 200 will decrease.

As shown in FIG. 10, two ends of the stiffening frame 200 (i.e., first end 210 and second end 220) may move in a way to change the resting curvature of the stiffening frame 200 to a first curvature associated with a first radius 260 ($R_{R1}$) and a first center 262 ($C_{R1}$). The stiffening frame 200 with the first curvature is less arcuate than the stiffening frame 200 with the resting curvature. The first center 262 of curvature is further away from the stiffening frame 200 than the resting center 252 of curvature is to the stiffening frame 200, and the first radius 260 of the stiffening frame 200 is greater than the resting radius 250 of the stiffening frame 200.

On the other hand, two ends of the stiffening frame 200 (i.e., first end 210 and second end 220) may move in a way to change the resting curvature of the stiffening frame 200 to a second curvature associated with a second radius 270 ($R_{R2}$) and a second center 272 ($C_{R2}$). The stiffening frame 200 with the second curvature is more arcuate than the stiffening frame 200 with the resting curvature. The second center 272 of curvature is closer to the stiffening frame 200 than the resting center 252 of curvature is to the stiffening frame 200, and the second radius 270 of the stiffening frame 200 is less than the resting radius 250 of the stiffening frame 200.

Figure 12A:
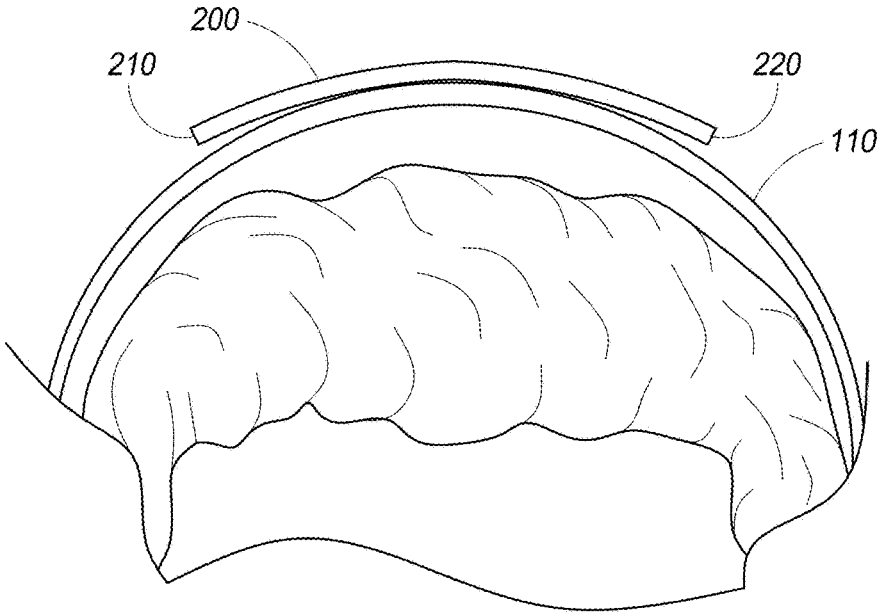
FIG. 12A is an illustration of a stiffening frame placed on a headband so that the headband is located between the stiffening frame and a wearer's head.
Figure 12B:
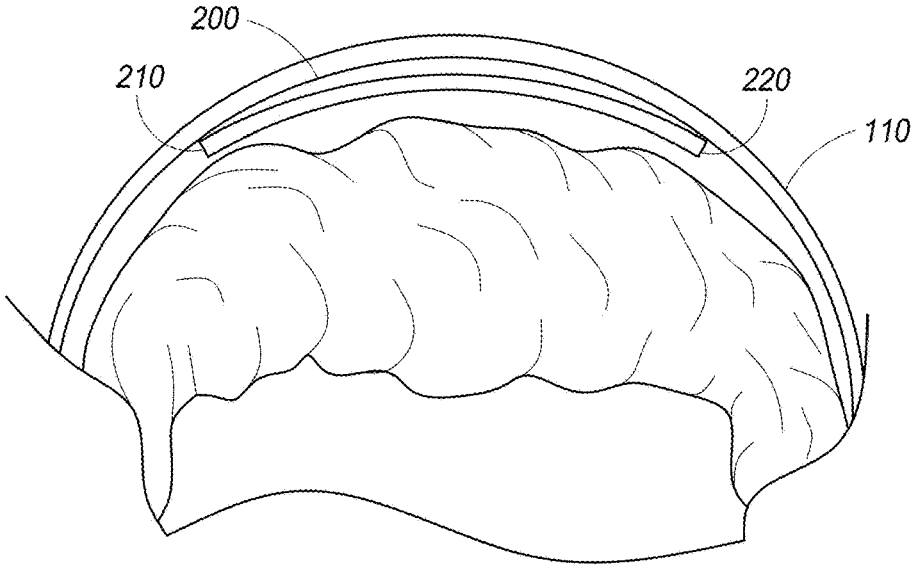
FIG. 12B is an illustration of a stiffening frame placed under a headband so that the stiffening frame is located between the headband and a wearer's head.

FIGS. 12A and 12B show different possible configurations of a stiffening frame 200 and a headband 110. As shown in FIG. 12A, the stiffening frame 200 and the headband 110 may be configured so that the headband 110 is placed between the stiffening frame 200 and a wearer's head. In some other embodiments, the stiffening frame 200 and the headband 110 may be configured so that the stiffening frame 200 is placed between the headband 110 and the wearer's head. As one with ordinary skill in the art would appreciate, when curvature of the stiffening frame 200 is changed (e.g., as shown in FIGS. 10 and 11) by moving first end 210 and second end 220 of the stiffening frame 200 towards the headband 110, curvature of the headband 110 will change to adjust distance 130 between the earpieces 120.

In some embodiments, the stiffening frame 200 may have a resting curvature so that the first end 210 and the second end 220 are operatively in contact with the headband 110. In such embodiments, force is exerted on a body portion 230 of the stiffening frame 200 so that the body portion 230 is moved closer towards the headband 110. As one with ordinary skill in the art would appreciate, when the body portion 230 of the stiffening frame 200 moves towards the headband 110, tension and compression forces are exerted on the stiffening frame 200. Those forces are translated to the headband 110 through the mechanical connection between the headband 110 and the stiffening frame 200. In some designs, different embodiments of a stiffening frame holder 300 (e.g., FIGS. 7, 8, and 9C) provide such mechanical connection between the headband 110 and the stiffening frame 200. In some other designs, different embodiments of a stiffening frame holder 400 (e.g., FIGS. 5A, 5B, and 9B) provide such mechanical connection between the headband 110 and the stiffening frame 200.

Figure 13:
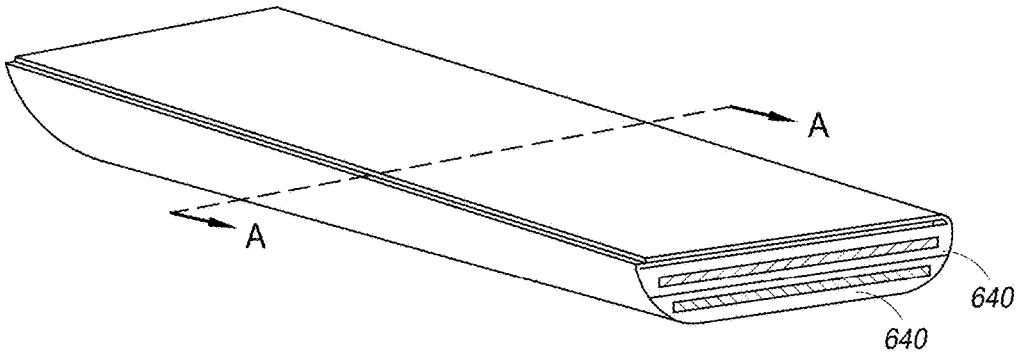
FIG. 13 is an illustration showing a perspective view and a cross-sectional view of a stiffening frame holder with two pockets.
Figure 13:
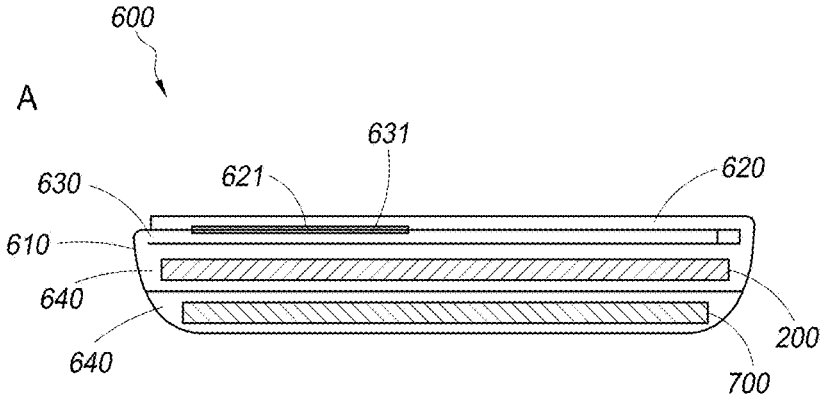

FIG. 13 illustrates an embodiment of a stiffening frame holder 600 with two pockets 640. Some embodiments of the stiffening frame holder 600 may include at least two pockets 640. The pocket 640 can be used for a stiffening frame 200 or a padding 700 as shown FIG. 13. The pockets 640 can be placed on top of one another so that one pocket 640 is located between center section 610 of the stiffening frame holder 600 and another pocket 640. In some embodiments, plurality of pockets 640 may be positioned in a grid formation. In some embodiments, pocket openings may be formed at both longitudinal ends of the stiffening frame holder 600. The pockets 640 may also incorporate various methods such as zipper or a hook to ensure that openings for the pockets 640 remain closed. In some embodiments, the padding 700 may be incorporated to the stiffening frame holder 600. In some embodiments, the padding 700 may also be incorporated to the stiffening frame 200. Various embodiments of stiffening frame holders may have one, two, or more than two pockets 640. The pockets 640 may have used for the padding 700 or the stiffening frame 200. In some embodiments, more than one stiffening frame 200 may be incorporated with various embodiments of stiffening frame holder.

The padding 700 may be made out of at least one of upholstery foams, polyurethane foams, regular standard foams, super soft foam, lux foam, HD36 foam, dry-fast foam, memory foam, vinyl nitrile, cottons, gel, rubber compounds, rubber cushioning, natural and synthetic fibers, air bladders, bubble bladders, air encapsulated plastic, inflatable bladder, or any other means to reduce or eliminate hot spots between the headset and the head. Dimensions of the padding 700 can range from 0.25 inch to 30 inches in length, 0.25 inch to 30 inches in width, and 0.125 inch to 6 inches in thickness.

Figure 14A:
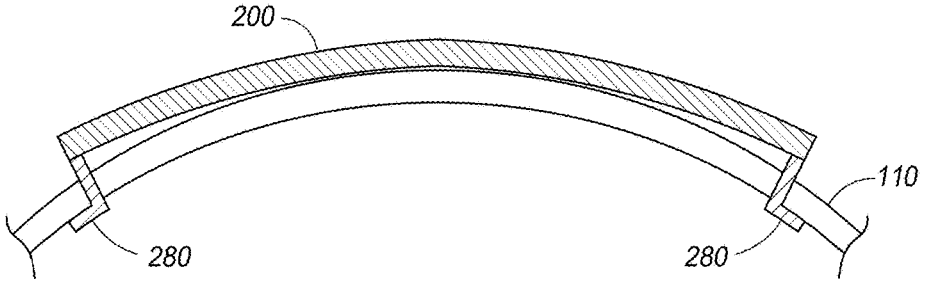
FIG. 14A is a side view of a stiffening frame integrated with at least one connector.
Figure 14B:
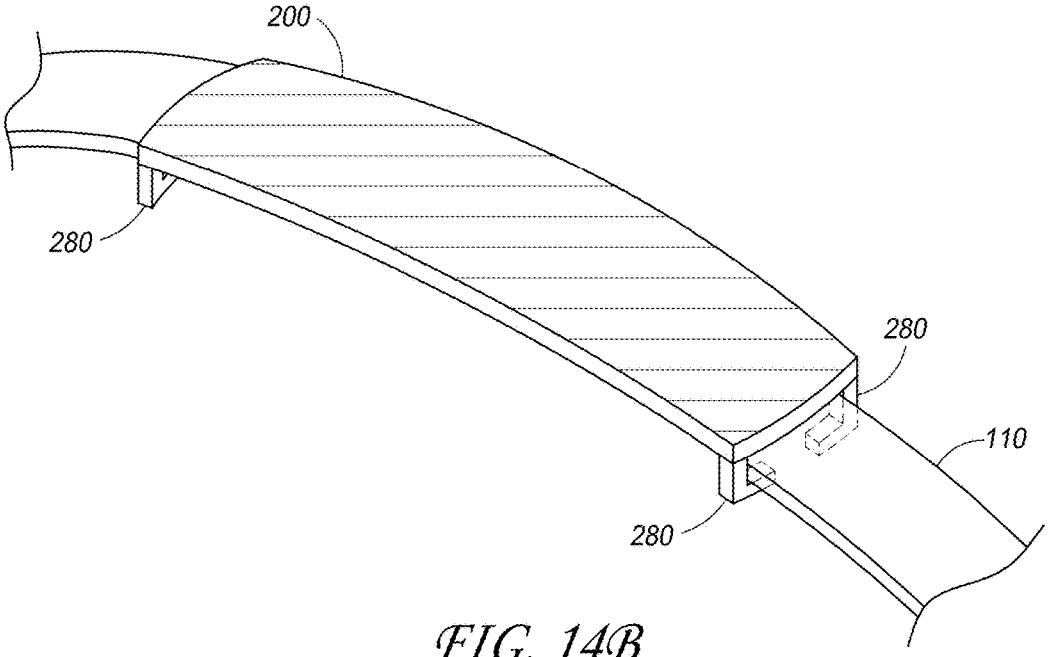
FIG. 14B is a perspective view of the stiffening frame shown in FIG. 14A.

FIGS. 14A and 14B show a side view and a perspective view of a stiffening frame stiffening frame 200 with at least one integrated connector 280. The integrated at least one connector 280 are placed around four corners of the stiffening frame 200. The connectors 280 may utilize one of hooking system, latch system, or other mechanisms to fixedly and releasably attach the stiffening frame 200 to a headband 110.

Figure 15A:
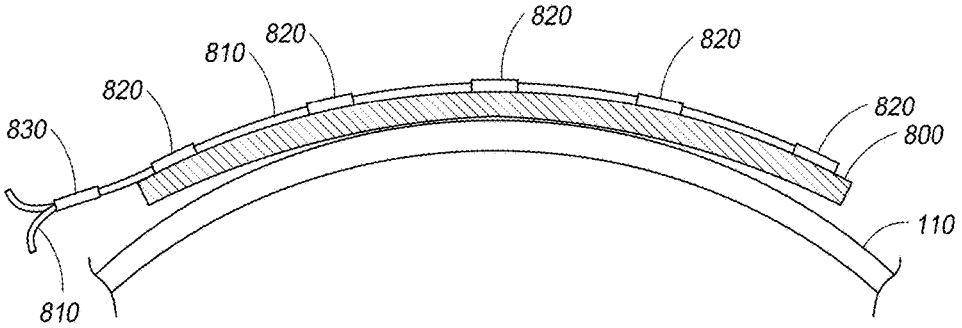
FIG. 15A is a side view of a stiffening frame with a frame adjustment system.
Figure 15B:
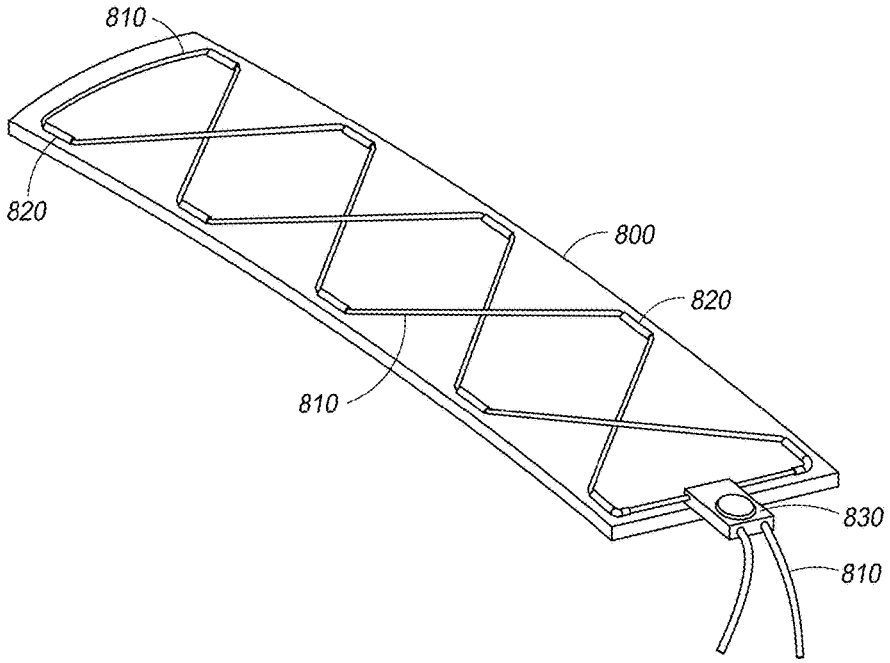
FIG. 15B is a perspective view of the stiffening frame shown in FIG. 15A.

FIGS. 15A and 15B show a side view and a perspective view of a stiffening frame 800 incorporating a frame adjustment system. The frame adjustment system comprises at least one lace 810, at least one loop 820, and at least one fastener 830. As shown in FIG. 15B, the at least one loop 820 is placed on a side of the stiffening frame 800 that is distal from a headband 110. In some embodiments, the at least one loop 820 is placed on both distal and proximal sides of the stiffening frame 800. The at least one lace 810 and the at least one loop 820 are configured so that a tension created within the at least one lace 810 adjusts curvature of the stiffening frame 800. The at least one fastener 830 is configured to receive the at least one lace 810 and includes a system to maintain position of the at least one lace 810 with respect to the fastener 830. The at least one fastener 830 can also maintain tension of the lace 810. Location of the fastener 830 and the loops 820 can be varied in various embodiments of the stiffening frame 800. The lace 810 can be made from extruded fibers of poly-paraphenylene terephthalamide. In some embodiments, the lace 810 can be made out of other materials that are flexible, strong, and durable over many cycles of use.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

All references cited herein, including but not limited to published and unpublished applications, patents, and literature references, and also including but not limited to the references listed in the Appendix, are incorporated herein by reference in their entirety and are hereby made a part of this specification. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification are to be understood as being modified in all instances by the term "about." Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention.

What is claimed is:

1. An apparatus for adjusting a curvature of a headset headband, the apparatus comprising:

a stiffening frame comprising;

a first end;

a second end opposite the first end, wherein a length of the stiffening frame is a distance between the first end and the second end; and a body portion extending between the first end and the second end, wherein the body portion has a width, a thickness, and a cross-sectional area, wherein the body portion is made of a material with a first Young's modulus, and wherein the body portion has an axial stiffness equal to a product of the cross-sectional area and the first Young's modulus divided by the length; and a stiffening frame holder configured to releasably attach the stiffening frame to a headband of a headset, wherein the stiffening frame is configured to adjust a natural curvature of the headband, and wherein the stiffening frame has a resting curvature within at least a portion of the length between the first end and the second end; and a frame adjustment system operatively connected to the stiffening frame, wherein the adjusting mechanism is configured to adjust the resting curvature of the stiffening frame to a second curvature, wherein the second curvature is different from the resting curvature, the frame adjustment system comprising:

a lace;

a plurality of loops positioned along the length the stiffening frame holder, wherein the resting curvature of the stiffening frame depends on a magnitude of tension in the lace; and a fastener operatively connected to the lace, wherein the fastener is configured to control and to maintain tension of the lace.

2. The apparatus of claim 1, wherein the lace comprises extruded fibers of poly-paraphenylene terephthalamide.

3. The apparatus of claim 1, further comprising a padding connected to the stiffening frame holder, wherein the stiffening frame holder is configured to position the padding between the headband and a head of the wearer so as to reduce or eliminate hot spots between the headset and the head, wherein the padding is releasably attached to the stiffening frame holder.

4. The apparatus of claim 3, wherein the padding is disposed within a pocket of the stiffening frame holder.

5. The apparatus of claim 1, wherein the stiffening frame holder wraps around at least a portion of the headband of the headset.

6. The apparatus of claim 5, wherein the stiffening frame holder wraps around at least the first end and the second end of the stiffening frame.

7. The apparatus of claim 1, wherein the stiffening frame holder comprises a pocket configured to hold at least one stiffening frame, wherein the pocket has dimensions that are sufficient for at least one stiffening frame to be disposed therein.

8. The apparatus of claim 1, wherein the width and the thickness of the body portion of the stiffening frame is uniform throughout.

9. The apparatus of claim 1, wherein the body portion of the stiffening frame is made of a plurality of materials.

10. A stiffening frame for adjusting a natural curvature of a headband of a headset, the stiffening frame configured for releasable attachment to the headband, wherein the headband is configured to cover at least a portion of a head of a wearer of the headset, the stiffening frame comprising:

a first end;

a second end opposite the first end, wherein a length of the stiffening frame is a distance between the first end and the second end;

a body portion having a top surface and a bottom surface, wherein the top surface has a first curvature associated with a first radius of curvature, wherein the bottom surface has a second curvature associated with a second radius of curvature, and wherein the body portion has a resting curvature within at least a portion of the length between the first end and the second end;

a stiffening frame connector configured to releasably attach the stiffening frame to the headband of the headset; and a frame adjustment system operatively connected to the stiffening frame, wherein the adjusting mechanism is configured to adjust the resting curvature of the stiffening frame to a second curvature, wherein the second curvature is different from the resting curvature, the frame adjustment system comprising:

a lace;

a plurality of loops positioned along the length the stiffening frame holder, wherein the resting curvature of the stiffening frame depends on a magnitude of tension in the lace; and a fastener operatively connected to the lace, wherein the fastener is configured to control and to maintain tension of the lace.

11. The stiffening frame of claim 10, wherein the first radius of curvature and the second radius of curvature are equal.

12. The stiffening frame of claim 10, wherein the stiffening frame is made out of a material system comprising at least one of nylon polymer, acrylic, or carbon fiber.

13. The stiffening frame of claim 10, wherein the stiffening frame connector comprises at least one of a hook and loop system, buttons, snaps, a zipper, magnets, or a lacing loop system.

14. The stiffening frame of claim 10, wherein the stiffening frame is connected to the headband of the headset and positioned such that the headband is between the stiffening frame and a head of the wearer.

15. A stiffening frame holder configured to attach a stiffening frame to a headband of a headset, wherein the headband has a natural curvature, and wherein the stiffening frame is configured to adjust a natural curvature of the headband, the stiffening frame holder comprising:

a center section comprising a pocket made out of a flexible material, wherein the pocket has dimensions that are sufficient for at least one stiffening frame to be disposed therein, wherein the center section comprises a first longitudinal periphery and a second longitudinal periphery extending between a first end and a second end of the center section, and wherein the center section comprises a first transverse periphery and a second transverse periphery extending between a first side and a second side of the center section;

a first wing connected to the first side of the center section, wherein the first wing has a transverse width corresponding to a distance from the first side of the center section to an outer edge of the first wing, and wherein the transverse width of the first wing is greater than a distance between the first side and the second side of the center section, the first wing rotatably foldable towards the second wing with respect to a first longitudinal axis defined by the first side of the center section;

a second wing operatively connected to the second side of the center section, wherein the second wing has a transverse width corresponding to a distance from the second side of the center section to an outer edge of the second wing, and wherein the transverse width of the second wing is substantially same as the distance between the first side and the second side of the center section, the second wing rotatably foldable towards the first wing with respect to a second longitudinal axis defined by the second side of the center section;

a first attachment apparatus connected to the first wing;

a second attachment apparatus connected to the second wing; and wherein when the first wing is folded towards the second wing and the second wing is folded towards the first wing, the first attachment apparatus and the second attachment apparatus operatively interacts to releasably attach the stiffening frame holder to the headband; and wherein the interaction between the first attachment apparatus of the first wing and the second attachment apparatus of the second wing adjusts the natural curvature of the headband.

* * * * *